US005324017A

United States Patent [19]

Bubley et al.

[11] Patent Number: 5,324,017

[45] Date of Patent: Jun. 28, 1994

[54] SCREEN PRINTING TAKE-OFF DEVICE

[75] Inventors: Henry J. Bubley, Deerfield, Ill.; David Landesman, St. Louis, Mo.

[73] Assignee: Lawson Screen Products, Inc., St. Louis, Mo.

[21] Appl. No.: 141,382

[22] Filed: Oct. 22, 1993

[51] Int. Cl.[5] ..... B65H 29/10

[52] U.S. Cl. ..... 271/85; 271/268

[58] Field of Search ..... 271/84, 85, 268

[56] References Cited

U.S. PATENT DOCUMENTS 3,729,190 4/1973 Harris ..... 271/85
3,792,857 2/1974 Bubley et al. .
4,031,824 6/1977 Bubley et al. .
4,058,307 11/1977 Bubley et al. .
4,242,956 1/1981 Bubley et al. .
4,512,563 4/1985 Bubley .
4,848,763 7/1989 Weir ..... 271/268
4,879,948 11/1989 Bubley .

*Primary Examiner*—Richard A. Schacher
*Attorney, Agent, or Firm*—Kalish & Gilster

[57] ABSTRACT

A take-off device for gripping and releasing an article has a gripper heat capable of imparting a downward force to an article gripped thereof. The gripper head has a lower jaw and an upper jaw, the lower jaw being capable of moving linearly with respect to the longitudinal axis of the take-off device. The upper jaw is capable of pivotal movement below the line of linear movement of the lower jaw after the lower jaw has moved linearly to release the article gripped by the gripper head, whereby a downward force to an article gripped and released by the take-off device may be imparted.

8 Claims, 3 Drawing Sheets

SCREEN PRINTING TAKE-OFF DEVICE

BACKGROUND AND SUMMARY OF THE INVENTION

The present invention relates generally to the field of take-off devices, and, more particularly, to a screen printing take-off device which grips printed stock and moves the stock away from the printing device and then, in an improved and unusual manner opens and releases the stock.

Paper stock take-off devices are well known in the paper printing trade which grab the paper stock, such as a poster, play bill, etc., pull it away from the printing device and then release the stock, letting it fall to a conveyor belt or other receptacle below the take-off point. Because such printing systems commonly operate at a very high rate, for example, up to approximately 1000 cycles per hour, precise timing and functioning of all elements of the equipment is critical. Unfortunately, with known take-off devices paper jams are a common problem.

Conventional take-off devices have one or more gripper heads, each having upper and lower jaws which "bite" together to grip and pull a piece of paper stock. To release the paper stock after it has been completely removed from the printing machine, one of the jaws simply opens up or down, while the other (usually the bottom jaw) remains stationary. Alternatively, both jaws pivot simultaneously but in opposite directions.

A problem occurs with known take-off devices because of the high rate of speed at which the system is operating. The paper being removed from the printer is being pulled at such a great velocity, that when the upper and lower jaws of the take-off device release from one another the paper does not, and indeed cannot, simply drop directly downwardly away from the jaws merely because the previously gripping and pulling jaws have released. Instead, it continues to travel under its own momentum toward the open jaws of the take-off mechanism.

Having opened, the lateral velocity of the jaws dramatically decreases to zero so that the jaws can reverse both direction of travel and velocity to return to the screen printer to remove the next set of printed stock. Because the lateral velocity of the jaws is decreasing while the just-released printed stock is continuing under its own inertia and momentum, the stock occasionally becomes jammed in the jaws.

As a result, the entire printing process must be stopped while the jam in the take-off device is cleared. Because such printing systems commonly operate at such high speeds, possibly printing multiple copies with each cycle, significant production volume is lost with each stock jam, decreasing productivity and increasing labor and material costs.

The new screen printing take-off device described and claimed herein is provided with a unique structure and operation which overcome the above problems by virtue of a gripping head which does not simply open its "mouth", but instead combines a sliding action which releases the printed stock with a pushing or "knock-down" action. The effect of this combined action is to mechanically force and direct the stock downwardly toward the conveyor below the take-off device.

Designed as described hereafter for use with flat-bed printers, the new take-off device makes printing operations much more efficient by virtually eliminating the above-described "paper-hang", stock jams which bring the operation to a temporary halt and damage individual stock pieces in the process. As a result of this improved paper releasing function, the path of travel of the gripper head carriage can be shorter than is usually necessary for removal of the gripper heads from the line of movement of the paper stock being taken off the printing line. Accordingly, the overall. length of the chassis upon which the carriage travels is also shorter, requiring less floor space, and of course, less material to make the chassis, improving operating and manufacturing costs, respectively.

Thus, it is among the several objects of the-present invention to provide an improved print stock take-off device for screen printing operations which has a relatively simple construction and thus is facile and inexpensive to manufacture and yet operates at high rates of speed without experiencing the usual paper jams.

It is further among the objects of the invention having the features enumerated above, that the new take-off device be constructed so that it can be easily operated with little or no additional training by a single individual already able to operate conventional take-off devices, and that it require a minimal amount of maintenance to remain in ideal operating condition.

It is also among the objects of the present invention that the overall length of the new take-off apparatus be shorter than would ordinarily be required.

It is further among the objects of the present invention, having the features enumerated, that the new take-off apparatus be adjustable with regard to gripper tension and positioning to accommodate variations in stock size and image location on the stock.

Accordingly, in furtherance of the above objects, the present invention is, briefly, a take-off device for gripping and releasing an article. The take-off device includes a gripper head capable of imparting a downward force to an article gripped thefeb. The gripper head has a lower jaw and an upper jaw. The lower jaw is capable of moving linearly with respect to the longitudinal axis of the take-off device and the upper jaw is capable of pivotal movement below the line of linear movement of the lower jaw after the lower jaw has moved linearly to release the article gripped by the gripper head, whereby a downward force to an article gripped and released by the take-off device may be imparted.

The present invention is also, briefly, a screen printing take-off device for removal of printed paper stock from a printing machine. The device includes a chassis supported above a floor and having parallel right and left sides, relative to a printing machine opposite end view of the device. A carriage is movably mounted upon the chassis so as to travel along a longitudinal axis thereof. The carriage has a plurality of support rods mounted rotatably thereon, transversely in relation to the path of travel of the carriage on the chassis. The device also includes structure for causing the carriage to move forward and backward on the chassis, away from and toward the printing machine from which the stock is to be removed. The device further includes at least one gripper head mounted on the rotatable support bars perpendicularly thereto in such a fashion as to cause gripping and releasing of stock gripped thereby upon rotation of the support bars. The at least one gripper head has an upper jaw and a lower jaw. The upper jaw is pivotally mounted on the gripper head and the lower jaw is slidably mounted on the gripper head in such manner that the lower jaw slides to release the stock from the gripper head and the upper jaw pivots, pushing the stock, to thereby mechanically force and direct the released stock to fall clear from the gripper head. Also included is structure for causing the lower jaw to slide, to thereby release the stock gripped by the gripper head, and structure for causing the upper jaw to pivot after the lower jaw has slid, to thereby forceably change the direction of travel of the stock.

Other objects will be in part apparent and in part pointed out hereinbelow.

BRIEF DESCRIPTION OF THE DRAWINGS

Throughout the figures like parts are indicated by like element numbers.

DESCRIPTION OF THE PREFERRED EMBODIMENT

Figure 1:
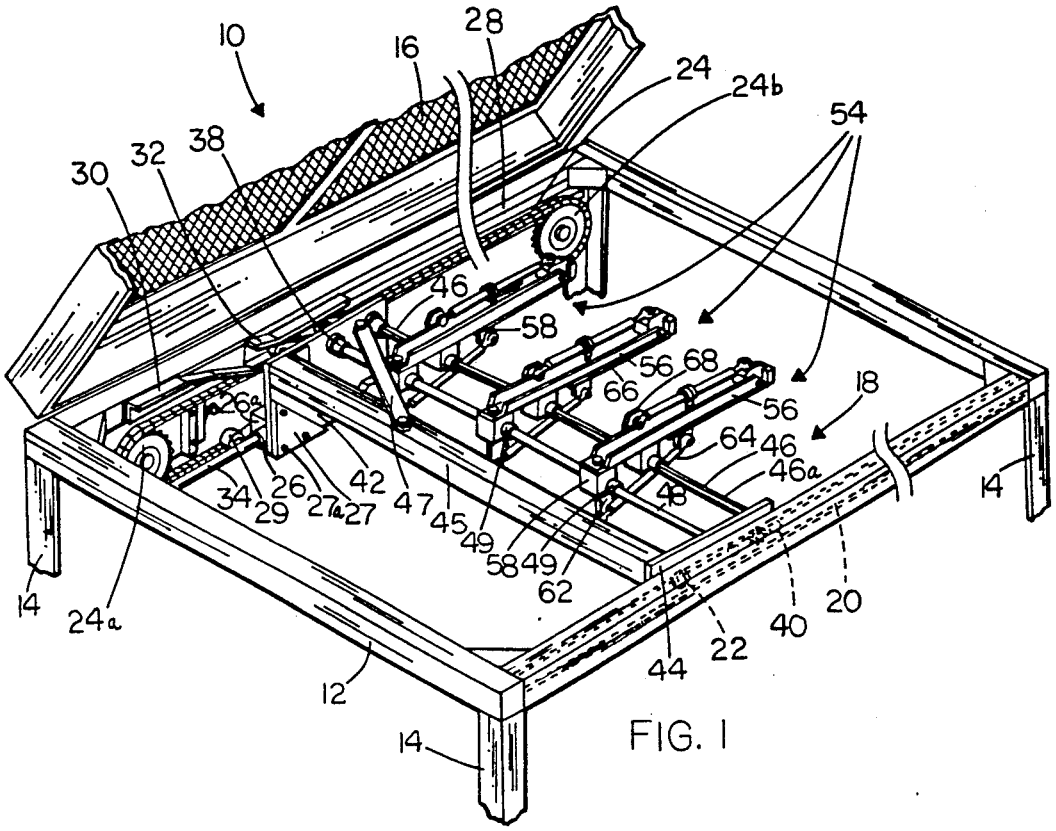
FIG. 1 is a perspective view of a screen printing take-off device constructed in accordance with and embodying the present invention.

With reference to the drawings, and particularly with regard to FIG. 1, 10 generally designates a screen printing take-off device constructed in accordance with and embodying the present invention. Take-off device 10 includes-a rigid, usually rectangular frame or chassis 12 supported generally horizontally above a floor upon optionally adjustable legs 14 at least at its four corners, and preferably shielded for safety during operation with a movable protective cover 16 (shown pivotally lifted for clarity and ease of discussion).

Figure 3A:
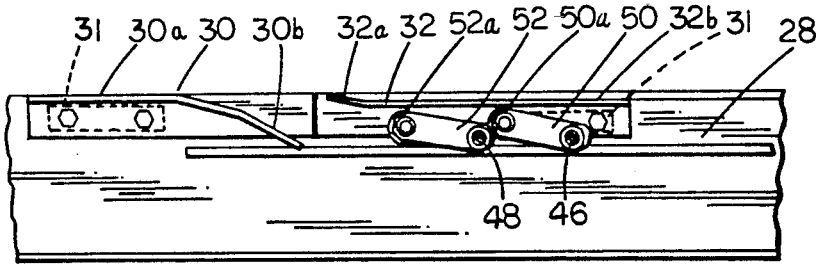
FIG. 3*a* is an enlarged elevational view of the camming mechanism of the device of FIG. 1 corresponding to the head position shown in FIG. 3*b*.
Figure 3B:
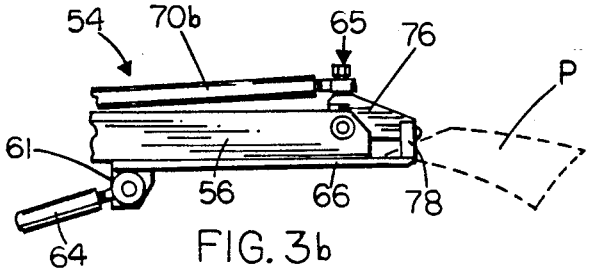
FIG. 3*b* is an enlarged right side elevational view of a gripper head of the take-off device of FIG. 1 partially broken away and with the lower jaw in gripping position.

Chassis 12 defines a longitudinal path along which a gripper head carriage, generally designated 18, travels back and forth thereon as it repeatedly grasps and removes paper stock (eg. P, shown in phantom in FIG. 3*b*) from a printing device (not shown) at the back end (upper right of FIG. 1) thereof. The grippers to be described carry the stock forwardly (toward the lower left of FIG. 1) before releasing it above a conveyor, not shown, and then returning to the rear of chassis 12 (toward the upper right of FIG. 1) for removal of the next printed piece of stock.

In the preferred embodiment, and as shown in phantom in FIG. 1, a channel 20 is provided along substantially the entire inside of the chassis long right side. Channel 20 serves as a track to receive and guide roller bearings 22 which are rotatably, vertically mounted on the right side of carriage 18 for smooth travel thereof along chassis 12.

As shown in FIG. 1, movement of carriage 18 on chassis 12 is preferably accomplished via a known, electrically triggered, pneumatically powered chain drive mechanism (only partially shown, for clarity), although other powering means could also be used successfully. At the left side of chassis 12 and along substantially the entire inside length thereof is mounted a drive chain 24 which is interengaged and turned by sprockets 24*a*, 24*b* rotatably vertically mounted in the usual manner at opposed ends of chassis 12. Chain 24 engages and causes movement therewith of carriage 18, at the left side of which there is a vertically disposed side plate 42 having the usual chain attach lever 29 for connection and movement of carriage 18 longitudinally on chassis 12.

The general framework of carriage 18 consists of left side plate 42 and right side plate 44 which are vertically disposed, substantially parallel to one another inward of the opposed longitudinal sides of chassis 12. Right side plate 44 serves in part as a site for mounting rollers 22 which travel in right chassis channel 20 and left side plate 42 serves in part in a somewhat related manner, as will be described.

Side plates 42, 44 are connected by a strong, rigid bar 45 fixed adjacent to the corresponding forward edges of the side plates, on the inside surfaces thereof. Bar 45 is disposed horizontally with relation to the longitudinal axis of device 10 and with relation to the line of travel of carriage 18.

The forward inside upper corner of plate 42 is connected at a substantially central location on transversely fixed bar 45 by a diagonally disposed rigid bar 47 for structural reinforcement of carriage 18. The lower inside rear corner of side plate 42 has mounted thereon a pin lift actuator bar 45 which extends sufficiently forwardly of plate 42 to contact a switch on the printing press and actuate lifting of pins which push the printed stock upwardly for access by gripper heads (to be described) mounted on carriage 18.

Carriage 18 travels during its forward and back cycle along a slide 34 which is securely mounted by its opposed ends longitudinally, adjacent to the left side of chassis 12, beneath drive chain 24. To ease the movement of carriage 18 on slide 34, at least one roller bearing 26 is mounted in a pillow block 26*a* fixed to the lower outside surface of side plate 42. Bearing 26 opens longitudinally and receives slide 34 completely therethrough in sliding journalled fashion. The inside lower surface of vertical side plate 42, opposite pillow block 26*a* is desirably reinforced by another, smaller plate 27 connected flush thereto with known connectors 27*a*.

Figure 2:
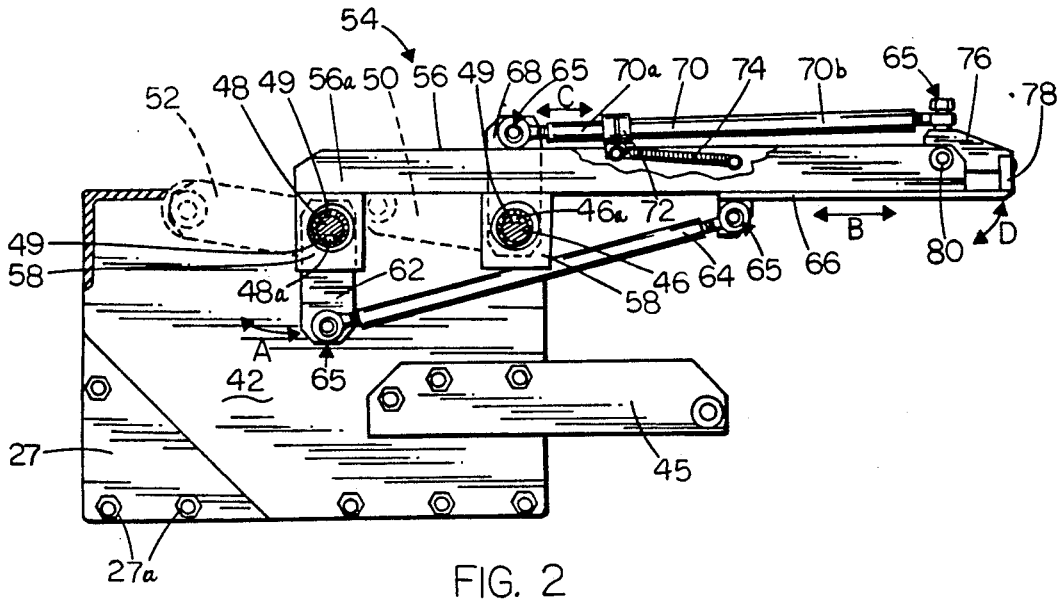
FIG. 2 is a right side elevational view of a gripper head of the take-off device of FIG. 1.

As shown in FIGS. 1 and 2, side plates 42, 44 of carriage 18 carry between them support rods 46, 48 which are rotatably mounted thereon by their opposed ends, which ends are journalled in bearings 38, 40 on left and right side plates 42, 44, respectively, of carriage 18. Rods 46, 48 are solid in construction but each have a straight walled groove 46*a*, 48*a*, respectively, formed therein for "keyed" or otherwise locking interconnection of other elements as will be described. Support rods 46, 48 are transversely disposed in relation to the longitudinal axis of chassis 12, but are parallel to one another, support rod 46 being positioned rearwardly of support rod 48.

A narrow "B-line" channel 28 is formed longitudinally on the inside left side wall of the chassis, just above the position of drive chain 24. Above the forward (operator-directed) end of channel 28, rearwardly of and substantially adjacent to drive chain sprocket 24*a* are guide ramps 30, 32.

Guide ramps 30, 32 are adjustably longitudinally mounted, as by groove and bolt connection assemblies 31 (shown in phantom in FIG. 3*a* only) in channel 28 above drive chain 24 and are disposed longitudinally in relation to each other, ramp 30 being forward of ramp 32. Guide ramps 30, 32 serve to engage and guide a camming mechanism of carriage 18 for operation of the essential portions of take-off device 10. Guide ramp 30 has an elongated, horizontal forward section 30*a* which extends rearwardly to intersect a downwardly sloped rearward section 30*b*. Guide ramp 30 is associated with movement of lower jaw 66, as will be described hereafter.

Guide ramp 32, which is directly rearward of and adjacent to guide ramp 30 includes a downwardly sloped forward section 32*a* which extends rearwardly to intersect an elongated horizontal rearward section 32*b*. As will be later explained more fully, guide ramp 32 is associated with movement of upper jaw 76.

Figure 4B:
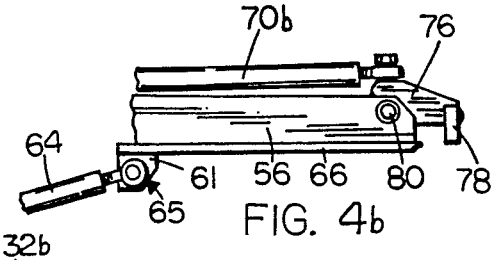
FIG. 4*b* is an enlarged right side elevational view of a gripper head of the take-off device of FIG. 1, partially broken away, with the lower jaw retracted.
Figure 4A:
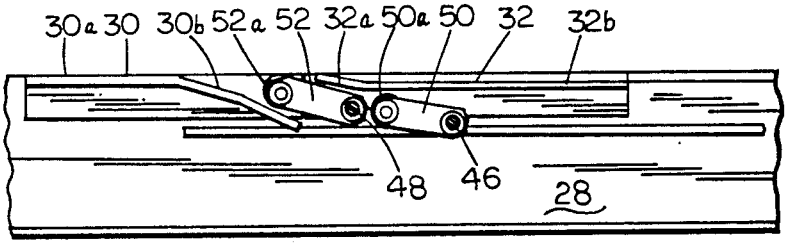
FIG. 4*a* is an enlarged elevational view of the camming mechanism of the device of FIG. 1 corresponding to a head position as shown in FIG. 4*b*.
Figure 5A:
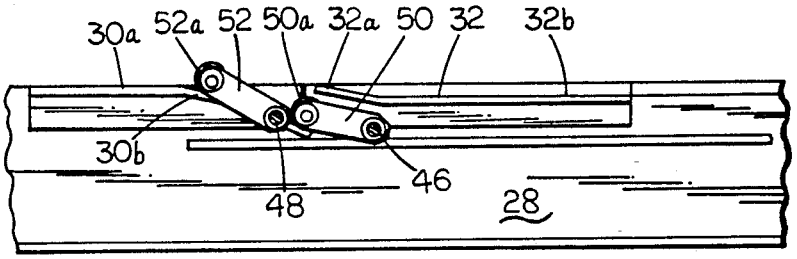
FIG. 5*a* is an enlarged elevational view of the camming mechanism corresponding to the head position of FIG. 5*b*.

The left ends of support rods 46, 48 extend through and terminate outwardly beyond left side plate 42 and have fixed thereon the rearwardly directed ends of cams 50, 52, respectively. As seen in the sequence of figures, FIGS. 3*a*, 4*a*, and 5*a* (drive chain 24 removed for clarity), cams 50, 52 are fixed to the left ends of support rods 46, 48 and extend forwardly (to the left in the drawings), perpendicularly thereto. Cams 50, 52 have mounted at their free outer ends corresponding cam actuator rollers 50*a*, 52*a* for rolling movement along and between guides 30, 32. Thus as carriage 18 travels forwardly from its position shown in FIG. 3*a* and approaches the forward end of chassis 12 roller 50*a* encounters and moves up the rearwardly angled portion 30*b* of guide ramp 30 (FIG. 4*a*).

The upwardly leveraged movement of cam 52 caused by movement of roller 52*a* moving up guide ramp 30 in turn causes support rod 48 to rotate clockwise (as seen from the right side). Immediately thereafter (in fact, almost simultaneously, due to the dimensions and positioning of the relevant parts), cam actuator roller 50*a* encounters the undersurface of sloped portion 32*a* of guide 32, and the attached cam 50 lifts, as will be explained it is biased to do, and causes support rod 46 connected thereto to also rotate clockwise, as seen from the right side of device 10. Conversely, when carriage 18 reaches the forward end of its cycle cams 50, 52 are in the position shown in FIG. 5*a* and then move through the positions shown in FIGS. 4*a* and 3*a*.

The significance of the described camming action becomes more apparent with understanding of the structure of the gripper head(s) 54 which are mounted on support rods 46, 48, longitudinally with relation to chassis 12. At least one such gripper head 54, described hereafter, is necessary on the new take-off device 10. The exact number of heads 54 disposed spaced apart, side-by-side on carriage 18 will vary depending upon the number, size and weight of the stock being taken off the printing line. For the most part, gripper heads 54 are formed preferably of aluminum. However, other materials will of course suffice.

The relative spacing of gripper heads 54 on support rods 46, 48 can be adjusted simply by release of preferably allen-headed screws (not shown) which penetrate rod-mounted collars 49 on opposed sides of each head 54, which collars 49 are locked into position by introduction of such a screw through a corresponding collar and into longitudinal locking grooves 46*a*, 48*a* of the relevant support rod.

Figure 7:
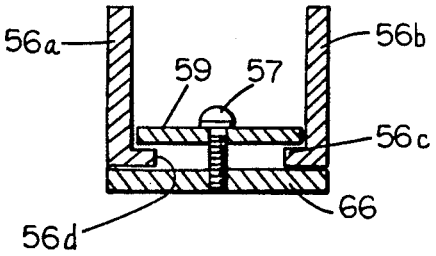
FIG. 7 is a vertical sectional view taken on line 7—7 of FIG. 6.

As seen most clearly in FIG. 2, each gripper head assembly 54 includes an upwardly opening length of channel iron (which is ordinarily actually aluminum) forming an elongated gripper arm 56 mounted at its forward end to support rod 48, and rearwardly thereof to support rod 46, perpendicularly in relation to support rods 46, 48 and longitudinally in relation to the path of travel of carriage 18. Gripper arm 56 is generally U-shaped in vertical section, as seen in FIG. 7, having an upstanding right wall 56*a*, an upstanding left wall 56*b* and a bottom wall 56*c* extending between and intersecting the right and left walls.

Bottom wall 56*c* of gripper arm 56 defines an elongated groove 56*d* which penetrates therethrough and serves as a path for travel therein of the shaft of a screw 57. Screw 57 passes downwardly through and supports an elongated flat strip or plate 59 which is sized so as to fit slideably within arm 56, between walls 56*a*, 56*b*, above bottom wall 56*c*, without slipping or dropping through groove 56*d*. The lowermost end of screw 57 threadably engages a flat strip 66, to be described further hereafter, which serves as a lower jaw for gripper head 54. Thus lower jaw 66 is mounted for slideable interengagement with gripper arm 54.

Support rods 46, 48 are rotatably connected to gripper arm 56 via mounting blocks 58 which each have a preferably brass bushing 60 therein, which bushings 60 are sized for rotatable journalling therein of rods 46, 48.

As shown in FIG. 2, adjacent to each mounting block 58 on support rod 48 is attached one end of a flat, elongated, depending bracket 62, the lower end of which moves-in an arc, as indicated by arrow A, when support rod 48 rotates. Depending bracket 62 is adjustably, non-rotatably attached to rod 48 by keyed interengagement with straight-walled groove 48*a* formed therein. If necessary, bracket 62 can be moved horizontally along the length of rod 48, for example if the position of an adjacent gripper head 54 is to be altered. This is accomplished by merely loosening screws (not shown) which penetrate an adjacent collar 49 and engage groove 48*a*.

Pivotally adjustably connected, for example as by bolt and eye assembly 65, to the lower end of depending bracket 62 is one end of a tie rod 64 which extends at an angle, upwardly and rearwardly, to similarly pivotally connect to the forward end of a flat, rigid, elongated lower jaw 66.

Figure 6:
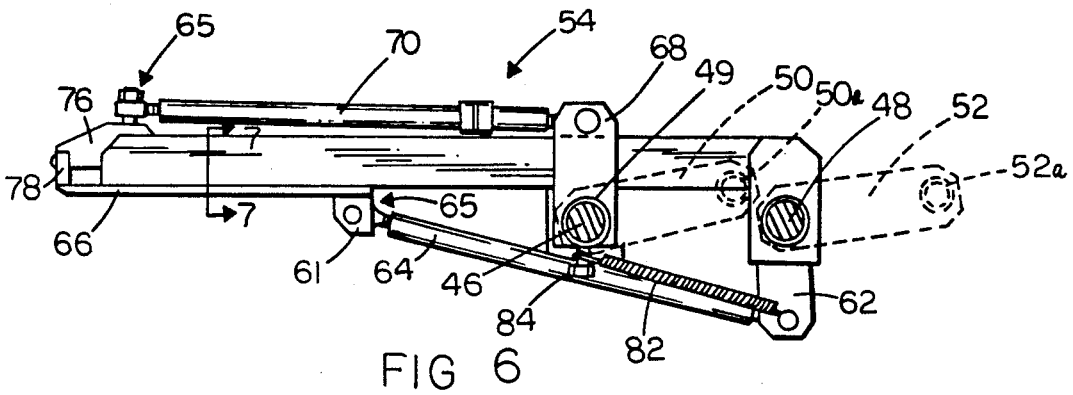
FIG. 6 is a left side elevational view of a gripper head of the take-off device of FIG. 1.

As shown in the vertical sectional view of FIG. 7, lower jaw 66 is slideably mounted via connecting plate 59 and screw 57 longitudinally to and beneath the lower front end of gripper arm 56. Lower jaw 66 extends rearwardly beyond the end of arm 56 when in stock gripping position as Arrow B in FIG. 2 indicates the linear movement of flat lower jaw 66 forwardly and rearwardly when pulled or pushed by rod 64 in response to corresponding movement of depending bracket 62, in keeping with rotational movement of support rod 48 as cam roller 52*a* ascends or descends sloped portion 30*b* of guide ramp 30. As seen in FIG. 6, this is accomplished by pivotal connection of tie rod 64 at its rearward end to the forwardmost end of lower jaw 66. This connection is accomplished, preferably by attachment of a bolt and eye assembly 65 to a shaft which penetrates a mounting block 61 which is fixed to lower jaw 60.

Adjacent to each mounting block 58 on support rod 46 is attached the lower end of a flat, elongated, upstanding bracket 68 which has pivotally connected at its upper end a forward section 70*a* of a tie rod 70. Bracket 68 is non-rotatably attached to rod 46 by virtue of keyed interlocking connection thereto with longitudinally formed, straight-walled groove 46*a*. Bracket 68 can be moved horizontally along rod 46 by sliding in groove 46*a*, in a manner similar to the earlier described movement of bracket 62, i.e., by loosening of the locking screw in an adjacent collar 49 which sandwiches the bracket next to the mounting block.

As seen in FIG. 2, a turnbuckle 72 threadably connects a forward section 70*a* to a rearward section 70*b* of tie rod 70 and permits limited longitudinal adjustment thereof. The rearwardmost end of upper tie rod 70 rear section 70*b* is adjustably connected to the top, forward end of an upper gripper jaw 76. The forwardmost section 70*a* of tie rod 70 is adjustably, pivotally connected as by a bolt and eye assembly 65 to the top end of upwardly directed bracket 68. Turnbuckle 72 is connected via coil spring 74 to gripper arm 56 to bias bracket 68 rearwardly, and thus, by the described connection of support rod 46, cam roller 50*a* is biased upwardly.

Figure 5B:
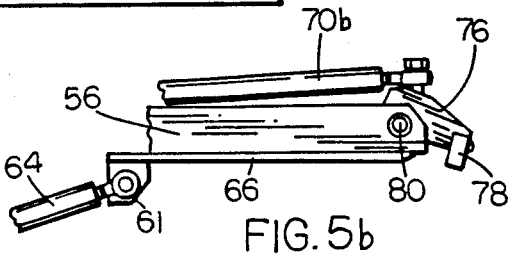
FIG. 5*b* is an enlarged right side elevational view of a gripper head of the take-off device of FIG. 1, partially broken away, with the top jaw in downward biting position.

Upper jaw 76 is preferably in the form of a block having a trapezoidal side elevational view with the narrowest portion facing rearwardly, toward the position of a printing machine and further having connected thereto a depending, preferably rubber lip 78. The forward end of upper jaw 76 is disposed between the upwardly extending sides of gripper arm 56 at the rearward end thereof. Upper jaw 76 is pivotally connected to the end of gripper arm 56 by a short, horizontally disposed pivot shaft 80 for permitting pivotal motion of upper jaw 76 and lip 78 both above and below the plane defined by lower jaw 66, as indicated by arrow D in FIG. 2 and as further illustrated by the varied positions of upper jaw 76 in FIGS. 3*b*, 4*b* and 5*b*.

The described movement of upper jaw 76 occurs in response to longitudinal pushing and pulling by tie rod 70 which is caused by movement of the upper end of upstanding bracket 68, as indicated by arrow C in FIG. 2, when support rod 46 rotates clockwise or counterclockwise responsive to the movement of cam 50 within guides 30, 32 as carriage 18 moves longitudinally on chassis 12. Top jaw 76 is biased to the up position shown in FIGS. 3*b* and 6 by a coil spring 82, shown in FIG. 6.

Coil spring 82 is connected at its forwardmost end (at the right of FIG. 6) to the bottom end of depending bracket 62, at the point of connection of tie rod 64. At its rearwardly directed end coil spring 82 is attached to a bolt 84 which threadably connects to the collar 49 which sandwiches upstanding bracket 68 against the mounting block for support rod 46. Thus, when depending bracket 62 swings forwardly with rotation of support rod 48 tension is place on spring 82, and when upper jaw 76 is in the downward, pushing position (FIG. 5*b*), which comes with subsequent rotation of support rod 46, the tension on spring 82 urges upper jaw 76 to return to the "resting" position of FIG. 6.

Thus as is seen, the particularly unique features of the described take-off device 10 are that the lower jaw moves forwardly before the upper jaw kicks downwardly, thereby preventing pinching of the stock between the two jaws. Also the upper jaw actually imparts a downward force to the paper stock to change the direction of momentum of the stock away from the gripper head. This is the only known take-off device which positively imparts a change in direction of the momentum of the paper stock upon release.

As is clear in light of the described structure, take-off device 10 presents definite advantages over any previously known printing take-off machines. Rather than having opposed upper and lower jaws which merely separate and eventually longitudinally out-distance the travelling stock, the new take-off device has a lower jaw 66 which slides horizontally, completely out of contact with the gripped paper P and out of the way of lip 78 which swings in an arc downwardly, completely past the rearward end of gripper arm 56, missing lower jaw 66 entirely, and pushes paper P out of the way, downwardly toward a conveyor belt or other receptacle. This combination of providing clearance and then pushing causes the stock to be clear of the gripper head 54 much more quickly than ever before possible. Accordingly, the overall length of chassis 12 can be shortened considerably because wasted longitudinal room, previously required to outrun the moving stock, is no longer necessary.

In view of the foregoing, it will be seen that the several objects of the invention are achieved and other advantages are attained.

Although the foregoing includes a description of the best mode contemplated for carrrying out the invention, various modifications are contemplated.

As various modifications could be made in the constructions herein described and illustrated without departing from the scope of the invention, it is intended that all matter contained in the foregoing description or shown in the accompanying drawings shall be interpreted as illustrative rather than limiting.

What is claimed is:

1. A take-off device for gripping and releasing an article, the take-off device comprising a gripper head capable of imparting a downward force to an article-gripped thereby, the gripper head having a lower jaw and an upper jaw, the lower jaw being capable of moving linearly with respect to the longitudinal axis of the take-off device and the upper jaw being capable of pivotal movement below the line of linear movement of the lower jaw after the lower jaw has moved linearly to release the article gripped by the gripper head, whereby a downward force to an article gripped and released by the take-off device may be imparted.

2. A screen printing take-off device for removal of printed paper stock from a printing machine, the device comprising;

a chassis supported above a floor and having parallel right and left sides, relative to a printing machine opposite end view of the device, a carriage movably mounted upon the chassis so as to travel along a longitudinal axis thereof, the carriage having a plurality of support rods mounted rotatably thereon, transversely in relation to the path of travel on the chassis, means for causing the carriage to move forward and backward on the chassis, away from and toward the printing machine from which the stock is to be removed, at least one gripper head mounted on the rotatable support bars perpendicularly thereto in such a fashion as to cause gripping and releasing of stock gripped thereby upon rotation of the support bars, the at least one gripper head having an upper jaw and a lower jaw, the upper jaw being pivotally mounted on the gripper head and the lower jaw being slidably mounted on the gripper head in such manner that the lower jaw slides to release the stock from the gripper head and the upper jaw pivots, pushing the stock, to thereby mechanically force and direct the released stock to fall clear from the gripper head, means for causing the lower jaw to slide, to thereby release the stock gripped by the gripper head and means for causing the upper jaw to pivot after-the lower jaw has slid, to thereby forceably change the direction of travel of the stock.

3. The take-off device of claim 2, wherein the gripper head is formed of an elongated section of channel iron forming an arm having first and second opposed ends, the upper jaw and the lower jaw being mounted at the first end of the arm and the second end of the arm being fixed to a plurality of mounting blocks, and further wherein each of the plurality of mounting blocks is penetrated by a bushing for rotatable penetration therethrough of one of the plurality of support rods.

4. The take-off device of claim 3, wherein the means for causing the lower jaw to slide includes a bracket attached to one of the plurality of support bars so as to move with rotation of the support bar attached thereto, and a tie rod extending between and connecting the bracket and the lower jaw, to thereby cause the lower jaw to slide upon rotation of the support bar connected to the bracket.

5. The take-off device of claim 3, wherein the means for causing the upper jaw to pivot includes a bracket attached Go one of the plurality of support bars so as to move with rotation of the support bar attached thereto, and a tie rod extending between and connecting the bracket and the upper jaw, to thereby cause the upper jaw to pivot upon rotation of the support bar connected to the bracket.

6. The take-off device of claim 2, wherein the plurality of support rods of the carriage is a first support rod and a second support rod, the first support rod and the second support rod being rotatably mounted parallel to one another and transversely in relation to the longitudinal axis of the chassis.

7. The take-off device of claim 6, wherein the means for causing the lower jaw to slide and the means for causing the upper jaw to pivot comprise means for causing rotation of the first support rod and means for causing rotation of the second support rod, the means for causing rotation being mounted on an end of the chassis and causing rotation of the first support rod and the second support rod only at the end of a grip and release cycle of the take-off device, and first contact means connected to the first support rod and second contact means connected to the second support rod for contacting the means for causing rotation of the first support rod and the means for causing rotation of the second support rod, respectively, to thereby cause the lower jaw to slide and the upper jaw to pivot.

8. The take-off device of claim 2, wherein the means for causing the carriage to move forward and backward on the chassis is a chain drive mechanism mounted longitudinally on the chassis and connected to an end of the carriage.

* * * * *

UNITED STATES PATENT AND TRADEMARK OFFICE

CERTIFICATE OF CORRECTION

PATENT NO. : 5,324,017

DATED : June 28, 1994

INVENTOR(S) : Bubley et al.

It is certified that error appears in the above-identified patent and that said Letters Patent is hereby corrected as shown below:

Claim 5, column 9, line 35, replace "go" with --to--.

Signed and Sealed this

Sixth Day of December, 1994

*Attest:*

*Attesting Officer*

Bruce Lehman

BRUCE LEHMAN

*Commissioner of Patents and Trademarks*